US009546347B2

(12) United States Patent
Benda et al.

(10) Patent No.: US 9,546,347 B2
(45) Date of Patent: Jan. 17, 2017

(54) COMBINATION PRODUCT HAVING TWO SEPARATE CLEANING COMPOSITIONS, BOTH HAVING A HIGH VISCOSITY

(71) Applicant: Henkel AG & Co. KGaA, Duesseldorf (DE)

(72) Inventors: Konstantin Benda, Duesseldorf (DE); Nina Muβmann, Willich (DE); Thomas Eiting, Duesseldorf (DE); Brigitte Kempen, Dormagen (DE); Thorsten Bastigkeit, Wuppertal (DE); Peter Schmiedel, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/612,347

(22) Filed: Feb. 3, 2015

(65) Prior Publication Data

US 2015/0148277 A1 May 28, 2015

Related U.S. Application Data

(63) Continuation of application No. PCT/EP2013/059860, filed on May 14, 2013.

(30) Foreign Application Priority Data

Aug. 3, 2012 (DE) ..... 10 2012 213 748

(51) Int. Cl.

| | |
|---|---|
| ***C11D 3/386*** | (2006.01) |
| ***C11D 3/39*** | (2006.01) |
| ***C11D 3/395*** | (2006.01) |
| ***C11D 17/04*** | (2006.01) |
| ***C11D 3/36*** | (2006.01) |
| ***C11D 11/00*** | (2006.01) |

(52) U.S. Cl.

CPC ..... *C11D 17/041* (2013.01); *C11D 3/361* (2013.01); *C11D 3/386* (2013.01); *C11D 3/38618* (2013.01); *C11D 3/3945* (2013.01); *C11D 3/3955* (2013.01); *C11D 3/3958* (2013.01); *C11D 11/0023* (2013.01)

(58) Field of Classification Search

CPC ..... C11D 3/361; C11D 3/386; C11D 3/39; C11D 3/395; C11D 9/446; C11D 11/0023; C11D 17/003; C11D 17/043

See application file for complete search history.

(56) References Cited

U.S. PATENT DOCUMENTS 4,260,528 A 4/1981 Fox et al.
5,954,213 A * 9/1999 Gerhart ..... B65D 21/0204 206/514
6,046,150 A * 4/2000 Choy ..... C07D 295/15 510/303
6,630,435 B1 * 10/2003 Gagliardini ..... C11D 3/395 510/310
6,844,305 B1 * 1/2005 Depoot ..... C11D 3/3715 510/303
6,995,125 B2 * 2/2006 Dasque ..... C11D 3/3907 510/296
7,179,780 B2 * 2/2007 Forth ..... C11D 3/2075 510/205
7,448,556 B2 * 11/2008 Muehlhausen .... B65D 81/3283 222/129
7,713,920 B2 * 5/2010 Ford ..... C11D 3/26 510/220
8,431,517 B2 * 4/2013 Song ..... C11D 3/0026 510/220
2002/0074347 A1 * 6/2002 Murray ..... B65D 1/04 222/129
2002/0142931 A1 10/2002 DeNome et al.
2003/0171234 A1 * 9/2003 Ajmani ..... C11D 1/94 510/195
2004/0127381 A1 * 7/2004 Scialla ..... C11D 3/0052 510/372
2004/0147423 A1 * 7/2004 Scialla ..... C11D 3/0052 510/372
2004/0181451 A1 * 9/2004 Boeckerman ..... B65D 23/14 705/14.49
2005/0164900 A1 * 7/2005 Masschelein ..... C11D 1/40 510/392
2009/0165821 A1 7/2009 Gentschev et al.
2009/0239778 A1 * 9/2009 Gentschev ..... C11D 3/30 510/223
2013/0146101 A1 6/2013 Gentschev et al.

FOREIGN PATENT DOCUMENTS

WO 01/85595 A1 11/2001
WO 02/074658 A1 9/2002

OTHER PUBLICATIONS

PCT International Search Report (PCT/EP2013/059860) dated Jul. 7, 2013.

* cited by examiner

*Primary Examiner* — Charles Boyer

(74) *Attorney, Agent, or Firm* — Thomas G. Krivulka

(57) ABSTRACT

The invention relates to fluid washing or cleaning products which are present as combination products comprising a packaging means and at least two fluid washing or cleaning compositions A and B that are located in said packaging means and that are separate from each other, wherein the two compositions A and B comprise A: 10 to 75 wt % of builder material(s); 0.1 to 10 wt % of enzyme preparation; 24.9 to 89.9 wt % of water; and B: less than 0.1 wt % of enzyme preparation; 0.5 to 90 wt % of water and at least one further ingredient of washing or cleaning products, and which fluid washing or cleaning products have an improved stability if the viscosity of the compositions A and B is above 1500 mPas.

9 Claims, No Drawings

COMBINATION PRODUCT HAVING TWO SEPARATE CLEANING COMPOSITIONS, BOTH HAVING A HIGH VISCOSITY

FIELD OF THE INVENTION

The present invention generally relates to combination products for washing or cleaning, preferably for cleaning hard surfaces. In particular, the invention relates to combination products for machine dishwashing, and a method for their use.

BACKGROUND OF THE INVENTION

Detergent compositions and cleaning agents for hard surfaces, as well as dishwasher detergents, are available to the consumer in numerous forms. In addition to the traditional solid agents, free-flowing and in particular liquid to gel-type detergents or cleaning agents have become increasingly important in recent times. To improve the cleaning performance of free-flowing detergent or cleaning agents, combination products have been proposed in the prior art which include a packaging means and two free-flowing detergents or cleaning agents that are situated in this packaging means and separate from one another. International Patent Application WO 2007/025665 discloses a packaging means and two free-flowing detergents or cleaning agents A and B that are situated in this packaging means and separate from one another, wherein composition A contains enzymes, and composition B contains no enzymes, or at least few enzymes. The spatial separation of these two compositions makes it possible for additional ingredients and characteristics of detergent or cleaning agents which could impair the stability of the enzymes to be kept separated from these enzymes, or also for other ingredients which could adversely affect one another to be kept separated, thus increasing the stability of the free-flowing agents during storage. For this reason, composition A, which contains enzymes, and composition B, which does not contain enzymes or contains enzymes only in small quantities, generally have different pH values. High pH values of, for example, pH 10, 11, or greater destabilize or inactivate enzymes, but are advantageous for removing stubborn soils.

Although in the prior art the problem of destabilization of enzymes during storage of free-flowing detergent or cleaning compositions has been solved by the above-mentioned combination products, there is the continuing problem of destabilization of enzymes during dosing of these agents. Regardless of whether dosing takes place via a dispensing drawer of an automatic washing machine, or a dispensing compartment of an automatic dishwasher, or a dosing ball or some other dosing device, the two phases intermix in the dosing device, or at the latest, in the first phase of the washing or cleaning operation, so that an average pH results which is lower than the pH of agent B but higher than that of agent A, and therefore the enzymes are exposed to a higher pH than originally intended.

To solve this problem, combination products are proposed which contain a packaging means and two free-flowing detergent or cleaning compositions A and B that are situated in this packaging means and separate from one another, wherein composition A contains 10 to 75% by weight builder(s), 0.1 to 10% by weight enzyme preparation, and 24.9 to 89.9% by weight water, and composition B contains less than 0.1% by weight enzyme preparation, 0.5 to 90% by weight water, and at least one further ingredient of detergent or cleaning agents, wherein the two compositions A and B each have a viscosity of greater than 1500 mPas. It is immaterial whether composition A and composition B have the same viscosity or different viscosities. No special requirements are imposed on the upper limit of the viscosity. However, both compositions should remain free-flowing.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Combination product comprising a packaging means and at least two free-flowing detergent or cleaning compositions A and B that are situated in the packaging means and separate from one another, wherein the two compositions A and B each contain: A: 10 to 75% by weight builder(s); 0.1 to 10% by weight enzyme preparation; 24.9 to 89.9% by weight water; and B: less than 0.1% by weight enzyme preparation; 0.5 to 90% by weight water; and at least one further ingredient of detergent or cleaning agents; characterized in that the two compositions A and B each have a viscosity of greater than 1500 mPas (measured with a DV-II+Pro Brookfield viscometer, 25 spindle, 50 rpm, 20° C.).

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The viscosity of the agents is measured using a Brookfield DV-II+Pro viscometer (25 spindle, 50 rpm, 20° C.). It is preferred that the viscosity of at least one of the two compositions A or B, preferably of both compositions A and B, is above 2000 mPas. If more than two compositions are to be present separate from one another in the packaging means, it is preferred that each of these compositions has a viscosity above 1500 mPas, preferably above 2000 mPas. In one particularly preferred embodiment of the invention, at least one of the compositions A and B, preferably at least composition B, has a viscosity between 3000 and 7000 mPas, particularly preferably between 3500 and 6500 mPas, in particular between 4000 and 6000 mPas.

The viscosity of compositions A and B, and thus possibly also a viscosity difference between compositions A and B, may be set in various ways known to those skilled in the art. One option is to add a thickening agent to one of the two compositions, or if necessary, to both compositions. Another option is to add a thickening agent to the composition which is to have the higher viscosity of the two compositions, or to add a thickening agent in greater quantities than for the agent having the lower viscosity.

Within the meaning of the present invention, polymeric thickening agents are polycarboxylates having a thickening effect as polyelectrolytes, preferably homo- and copolymers of acrylic acid, in particular acrylic acid copolymers such as acrylic acid-methacrylic acid copolymers, and the polysaccharides, in particular heteropolysaccharides, and other customary thickening polymers. Xanthans and xanthan gum are preferred thickening agents.

Likewise preferred are thickening polyacrylates, obtainable under the trade name Carbopol®, for example, or known thickening agents based on starch or cellulose.

The content of polymeric thickening agent is preferably 0.1 to 5% by weight, in particular 0.5 to 3% by weight, based on the particular composition to be thickened.

Another option, which may also be utilized in combination with a thickening agent, is to vary the quantities of certain solid raw materials in compositions A and B. For example, builders which are added in solid form during preparation of the compositions are suitable for this purpose. For example, to this end different quantities of phosphate may be used in phosphate-containing compositions. Phosphate-containing compositions, in particular phosphate-containing compositions A, may therefore even be free of additionally added thickening agents.

In addition to the two liquid cleaning compositions A and B, the combination products according to the invention also include a packaging means. The two cleaning compositions A and B are separate from one another in this packaging means; i.e., they do not form a shared phase boundary, but instead are present in separate areas of the packaging means which are separated by a partition, for example.

For example, a two- or multi-chamber container which is insoluble in water is suited as such a packaging means. Such a two- or multi-chamber container typically, but not necessarily, has a total volume between 100 and 5000 mL, preferably between 200 and 2000 mL. The volume of the individual chambers is preferably between 50 and 2000 mL, preferably between 100 and 1000 mL. Preferred two- or multi-chamber containers have a bottle shape.

For dosing the liquid detergent or cleaning agents, the two- or multi-chamber container preferably has at least one outlet, which may be designed, for example, in the form of a shared outlet for all compositions contained in the bottle. However, two- or multi-chamber containers are preferred in which each of the receiving chambers of the container has its own outlet. For example, contamination of individual chambers by ingredients from another chamber is avoided by such a design.

Combination products according to the invention, which for the packaging means are two- or multi-chamber containers which are insoluble in water, wherein preferably each of the receiving chambers of the packaging means is provided with an outlet, are preferred.

In order to bring a liquid agent into a pre-portioned form, it is customary to use water-soluble films in the form of pouches. Those skilled in the art are familiar with how to produce water-soluble one-chamber or multi-chamber bags. In one preferred embodiment of the invention, the packaging means is therefore composed of a water-soluble multi-chamber bag.

In the case of a detergent, the dosing of the two free-flowing detergent or cleaning compositions A and B may take place via a dispensing drawer of the washing machine, or via a separate dosing device such as a dosing ball which is placed directly in the washing drum. In the case of a machine dishwasher detergent product, the dosing may take place, for example, into the dosing chamber in the door or into an additional dosing container inside the dishwasher, or directly onto the soiled dishware. Alternatively, the two detergent or cleaning agents may be dosed at one of the interior walls of the dishwasher, such as the inner side of the door.

In one preferred embodiment of the invention, a water-soluble multi-chamber bag containing an individual portion of a machine dishwasher detergent is dosed via the dosing chamber or the utensil compartment, advantageously via the dosing chamber.

The detergent or cleaning compositions A and B of these embodiments must be free-flowing under the conditions of use. This is understood to mean that compositions A and B may be dosed from the packaging means into the provided machine or dosing device without further aids. If the packaging means is to be made of a flexible material, compositions A and/or B may also exhibit rheological behavior such that in the resting state they are not free-flowing in the packaging means, but under light pressure by the user on the packaging means or by shaking they may be converted into a free-flowing state, and thus dosed. These generally involve liquid agents which are free-flowing under normal conditions of use, and whose viscosities may vary over a wide range. Within the scope of the present invention, the liquid preparations also include gel-type or paste-like agents.

Preferred combination products of the present invention include free-flowing, in particular liquid to gel-type, cleaning agents which are suitable for use in machine dishwashers. Water-soluble multi-chamber bags containing compositions A and B whose viscosities greatly differ, and/or whose viscosities are each above 2500 mPas, are preferred.

In particular, water-soluble multi-chamber bags in which composition B has a higher viscosity than composition A have proven suitable. Embodiments of this type are preferred in particular when the ingredients of composition A are to be dispersed more quickly in the washing or cleaning solution, and therefore are to be provided to the washing or cleaning process earlier than ingredients of composition B. In particular in the case of water-soluble multi-chamber containers, the higher viscosity of composition B compared to composition A has proven advantageous, since a distribution of composition B which is time-delayed compared to composition A may be achieved without the need for imposing special requirements on the film of the multi-chamber bags, for example, that the film which forms one chamber whose contents are to be dispersed more slowly in the washing or cleaning solution than the film which forms the other chamber, is modified using measures known to those skilled in the art, such as coating, in such a way that the first-mentioned film dissolves more slowly. It is also not necessary for the multi-chamber containers to be made of different films having different water solubility kinetics. On the contrary, due to the different viscosities of the two compositions A and B, the multi-chamber containers may be made of the same film material.

The ingredients in the combination products according to the invention having washing or cleaning activity include builders. The builders include in particular zeolites, silicates, carbonates, organic co-builders, and, where there are no environmental restrictions on use, also phosphates. The builders are contained at least in composition A, but may also be contained in composition B. In one preferred embodiment of the invention, however, composition B contains no more than 5% by weight builders, based on the overall composition, and is preferably free of builders.

Suitable as silicates are amorphous sodium silicates having an $Na_2O:SiO_2$ module of 1:2 to 1:3.3, preferably 1:2 to 1:2.8, in particular 1:2 to 1:2.6, as well as crystalline layered silicates of the general formula $NaMSi_xO_{2x+1}.y\ H_2O$, where M represents sodium or hydrogen, x stands for a number from 1.9 to 22, preferably from 1.9 to 4, particularly preferred values for x being 2, 3, or 4, and y stands for a number from 0 to 33, preferably from 0 to 20.

Within the scope of the present invention, it is preferred that this/these silicate(s), preferably alkali silicates, particularly preferably crystalline or amorphous alkali disilicates, is/are contained in cleaning composition(s) A and/or B in quantities of 2 to 40% by weight, preferably 3 to 30% by weight, in particular 5 to 25% by weight, in each case based on the overall composition.

To the present day, phosphates continue to be preferentially used in machine dishwasher detergents in many parts of the world. Of the numerous commercially available phosphates, the alkali metal phosphates, particularly preferably pentasodium or pentapotassium triphosphate (sodium or potassium tripolyphosphate), have the greatest importance in the detergent and cleaning agent industry.

"Alkali metal phosphates" is the collective term for the alkali metal (in particular sodium and potassium) salts of the various phosphoric acids, of which a distinction may be made between metaphosphoric acids $(HPO_3)_n$, and orthophosphoric acid ($H_3PO_4$), in addition to higher-molecular representatives. The phosphates combine several advantages: they act as alkali carriers, prevent lime deposits on machine parts or lime incrustations in fabrics, and also contribute to the cleaning performance.

When phosphates are used within the scope of the present patent application as detergent or cleaning active substances in the liquid cleaning compositions A and/or B, preferred combination products contain this/these phosphate(s), preferably alkali metal phosphate(s), particularly preferably pentasodium or pentapotassium triphosphate (sodium or potassium tripolyphosphate), in quantities of 5 to 60% by weight, preferably 8 to 45% by weight, in particular 10 to 40% by weight, in each case based on the overall composition. In one preferred embodiment of the invention, composition A contains more phosphates than composition B. In another preferred embodiment, composition A contains phosphates in quantities of 20 to 45% by weight, in particular 20 to 40% by weight, in each case based on composition A. Composition B is preferably free of phosphates.

In particular polycarboxylates/polycarboxylic acids, polymeric polycarboxylates, asparaginic acid, polyacetals, dextrins, further organic co-builders, and phosphonates are mentioned as organic co-builders.

Examples of usable organic builder substances are the polycarboxylic acids which are usable in the form of the free acid and/or their sodium salts, wherein polycarboxylic acids are understood to mean those carboxylic acids bearing more than one acid function. Examples include citric acid, adipic acid, succinic acid, glutaric acid, malic acid, tartaric acid, maleic acid, fumaric acid, sugar acids, aminocarboxylic acids, nitrilotriacetic acid (NTA), provided such use is not objectionable for environmental reasons, and mixtures thereof. The free acids, in addition to their builder effect, typically also have the property of an acidification component, and are thus also used for setting a lower, milder pH value of detergent or cleaning agents. In particular citric acid, succinic acid, glutaric acid, adipic acid, gluconic acid, and any given mixtures thereof are mentioned in this regard.

Aminocarboxylic acids and/or their salts represent another important class of phosphate-free builders. Particularly preferred representatives of this class are methylglycinediacetic acid (MGDA) or its salts, and glutamine diacetic acid (GLDA) or its salts. The content of these aminocarboxylic acids or their salts may be, for example, 0.1 to 15% by weight, based on the overall composition.

Also suited as builders are polymeric polycarboxylates such as the alkali metal salts of polyacrylic acid or of polymethacrylic acid, for example those having a relative molecular mass of 500 to 70,000 g/mol.

As a further component, the combination products according to the invention contain enzymes for increasing the washing or cleaning performance. These include in particular proteases, amylases, lipases, cutinases, cellulases, hemicellulases, which in particular also include mannanases, xanthan lyases, pectin lyases (pectinases), pectinesterases, pectate lyases, xyloglucanases (xylanases), pullulanases, and β-glucanases, or oxidoreductases, and preferably mixtures thereof. In principle, these enzymes are of natural origin; starting from the natural molecules, improved variants are available for use in detergent and cleaning agents, and may therefore preferably be used. Detergent or cleaning agents preferably contain enzymes in overall quantities of $1\times10^{-6}$ to 5% by weight, based on active protein. The protein concentration may be determined using known methods such as the BCA method or the biuret method.

Of the proteases, those of the subtilisin type are preferred. Examples of usable amylases are the α-amylases from *Bacillus licheniformis*, from *B. amyloliquefaciens*, from *B. stearothermophilus*, from *Aspergillus niger* and *A. oryzae*, and refinements of the above-mentioned amylases which are enhanced for use in detergent and cleaning agents. For this purpose, the α-amylases from *Bacillus* sp. A 7-7 (DSM 12368) and cyclodextrin glucanotransferase (CGTase) from *B. agaradherens* (DSM 9948) are also emphasized.

The enzymes may be used in any form of a so-called enzyme preparation that is established according to the prior art. Examples include solid preparations obtained by granulation, extrusion, encapsulation, or lyophilization or, in particular for agents in the form of a liquid or gel, solutions of the enzymes, advantageously preferably concentrated, low in water, and/or combined with stabilizers. Within the scope of the present invention, "enzyme" or "enzymes" is/are understood to mean a corresponding enzyme preparation, if it is not specifically indicated that the active protein is intended.

It is also possible to prepare two or more enzymes together, so that an individual granulate or an individual enzyme preparation may have multiple enzyme activities.

As stated at the outset, the weight fraction of the enzymes in the total weight of the free-flowing detergent or cleaning composition A is 0.1 to 10% by weight, advantageously 0.2 to 9% by weight, in particular 0.5 to 8% by weight. Particularly good cleaning performance is achieved when the weight fraction of the enzymes in the overall composition is 1 to 8% by weight, preferably 2 to 5% by weight.

Although the free-flowing cleaning composition B may of course also contain enzymes, it is preferred that the enzyme content of cleaning composition B is as low as possible, in particular less than 0.1% by weight. Particularly preferred combination products are characterized in that the free-flowing cleaning composition B contains no enzymes, and the total quantity of enzymes is provided via free-flowing cleaning composition A.

One or more enzymes and/or enzyme preparations, preferably solid or liquid protease preparations and/or amylase preparations, is/are preferably used. In one preferred embodiment of the invention, liquid composition A includes an enzyme preparation which contains amylase. In one particularly preferred embodiment, liquid composition A includes a combination of protease and amylase preparations.

The combination products according to the invention may also contain enzyme stabilizers. Reversible protease inhibitors represent one group of stabilizers. Frequently used for this purpose are benzamidine hydrochloride, borax, boric acids, boronic acids, or their salts or esters, in particular derivatives containing aromatic groups, such as ortho-, meta-, or para-substituted phenylboronic acids, in particular 4-formylphenylboronic acid, or the salts or esters of the named compounds. Peptide aldehydes, i.e., oligopeptides having a reduced C terminus, in particular those composed of 2 to 50 monomers, are also used for this purpose. The peptidic reversible protease inhibitors include, among others, ovomucoid and leupeptin. Specific reversible peptide inhibitors for the protease subtilisin, as well as fusion proteins composed of proteases and specific peptide inhibitors, are also suited for this purpose.

Other enzyme stabilizers are aminoalcohols such as mono-, di-, triethanolamine and -propanolamine and their mixtures, aliphatic carboxylic acids up to $C_{12}$, such as succinic acid, other dicarboxylic acids, or salts of the named acids. End group-closed fatty acid amidalkoxylates are also suited for this purpose. Certain organic acids used as builders, as disclosed in WO 97/18287, are also able to stabilize a contained enzyme.

Further enzyme stabilizers are known to those skilled in the art from the prior art.

Combinations of stabilizers are particularly preferably used, for example combinations of polyols such as glycerin, ethylene glycol, propylene glycol, or sorbitol, and boric acid and/or borax, the combination of boric acid or borate, reducing salts, and succinic acid or other dicarboxylic acids, or the combination of boric acid or borate with polyols or polyamino compounds and with reducing salts. The action of peptide aldehyde stabilizers is advantageously enhanced by the combination with boric acid and/or boric acid derivatives and polyols, and even further by the additional action of divalent cations such as calcium ions.

The above-described agents according to the invention may contain, in addition to the previously described ingredients, further substances having washing and cleaning activity, preferably substances having washing and cleaning activity from the group of surfactants, polymers, glass corrosion inhibitors, corrosion inhibitors, alkali carriers, fragrances and fragrance carriers, dyes, and preservatives. Bleaching agents and bleach activators, in particular liquid bleach activators, may likewise be present. These preferred ingredients are described in greater detail below.

The group of surfactants includes nonionic, anionic, cationic, and amphoteric surfactants.

The anionic surfactants include those containing at least one sulfate or sulfonate group, preferably selected from fatty alcohol sulfates, alkyl ether sulfates, alkane sulfonates, and alkylbenzene sulfonates. Preferred are $C_{12}$-$C_{18}$ fatty alcohol sulfates such as Sulfopon K 35 (BASF, Germany), ethoxylated $C_{12}$-$C_{14}$ alcohol sulfates such as Texapon N70 (BASF, Germany), secondary $C_{13}$-$C_{17}$ alkane sulfonates such as Hostapur SAS 93 (Clariant, Germany), and $C_8$-$C_{18}$ alkylbenzene sulfonates, in particular dodecylbenzene sulfonate or $C_9$-$C_{13}$ benzene sulfonate.

All nonionic surfactants known to those skilled in the art may be used as nonionic surfactants. These include, for example, ethoxylated and/or propoxylated alcohols or fatty alcohols as well as nonionic surfactants of the aminoxide type, such as N-coco alkyl-N,N-dimethylaminoxide and N-tallow alkyl-N,N-dihydroxyethylaminoxide, and the fatty acid alkanolamides.

Nonionic surfactants from the group of alkoxylated alcohols, in particular the alkoxylated linear $C_8$-$C_{18}$ alcohols or the methyl-branched straight-chain or nonstraight-chain alcohols, particularly preferably from the group of mixed alkoxylated alcohols and in particular from the group of EO-AO-EO nonionic surfactants, are particularly preferably used.

Within the scope of the present invention, low-foaming nonionic surfactants having alternating ethylene oxide and alkylene oxide units have proven to be particularly preferred nonionic surfactants. Of these, surfactants having EO-AO-EO-AO blocks are preferred, in which in each case one to ten EO or AO groups, respectively, are bound to one another before a block made up of the respective other group follows. Nonionic surfactants of the general formula $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

are preferred here, in which $R^1$ stands for a straight-chain or branched, saturated or mono- or polyunsaturated $C_{6-24}$ alkyl or alkenyl radical; each group $R^2$ or $R^3$ is independently selected from $-CH_3$, $-CH_2CH_3$, $-CH_2CH_2-CH_3$, $CH(CH_3)_2$, and the indices w, x, y, z independently stand for integers from 1 to 6.

Thus, in particular nonionic surfactants are preferred which contain a $C_{9-15}$ alkyl radical having 1 to 4 ethylene oxide units, followed by 1 to 4 propylene oxide units, followed by 1 to 4 ethylene oxide units, followed by 1 to 4 propylene oxide units. In aqueous solution these surfactants have the required low viscosity, and are particularly preferably usable according to the invention.

Surfactants of the general formula $$R^1-\underset{\underset{R^2,}{|}}{CH(OH)}CH_2O-(AO)_w-(A'O)_x-(A''O)_y-(A'''O)_z-$$

in which $R^1$ and $R^2$ independently stand for a straight-chain or branched, saturated or mono- or polyunsaturated $C_{2-40}$ alkyl or alkenyl radical; A, A', A'', and A''' independently stand for a radical from the group $-CH_2CH_2$, $-CH_2CH_2-CH_2$, $-CH_2-CH(CH_3)$, $-CH_2-CH_2-CH_2-CH_2$, $-CH_2-CH(CH_3)-CH_2-$, $-CH_2-CH(CH_2-CH_3)$; and w, x, y, and z stand for values between 0.5 and 90, where x, y, and/or z may also be 0, are particularly preferred according to the invention.

In one preferred embodiment, very particularly preferred nonionic surfactants have the general formula $R^1O[CH_2CH(CH_3)O]_x[CH_2CH_2O]_y[CH_2CH(CH_3)O]_zCH_2CH(OH)R^2$, in which $R^1$ stands for a linear or branched aliphatic hydrocarbon radical containing 4 to 22 carbon atoms or mixtures thereof, $R^2$ stands for a linear or branched hydrocarbon radical containing 2 to 26 carbon atoms, in particular 4 to 20 carbon atoms, or mixtures thereof, and x and z stand for values between 0 and 40 and y stands for a value of at least 15.

The addition of these nonionic surfactants has proven advantageous in particular with regard to clear rinse performance and drying. In one preferred embodiment, the machine dishwasher detergent, based on the sum of compositions A and B, contains nonionic surfactant of the general formula $R^1O[CH_2CH(CH_3)O]_x[CH_2CH_2O]_y$ $[CH_2CH(CH_3)O]_zCH_2CH(OH)R^2$ in quantities of 0.1 to 15% by weight, preferably 0.2 to 10% by weight, particularly preferably 0.5 to 8% by weight, in particular 1.0 to 6% by weight.

Preferred in particular are those end group-closed poly (oxyalkylated) nonionic surfactants according to the formula $R^1O[CH_2CH_2O]_yCH_2CH(OH)R^2$, in which $R^1$ stands for a linear or branched aliphatic hydrocarbon radical containing 4 to 22, in particular 6 to 16, carbon atoms or mixtures thereof, $R^2$ stands for a linear or branched hydrocarbon radical containing 2 to 26, in particular 4 to 20, carbon atoms or mixtures thereof, and y stands for a value between 15 and 120, preferably between 20 and 100, in particular between 20 and 80. The group of these nonionic surfactants includes, for example, hydroxy mixed ethers of the general formula $C_{6-22}$—$CH(OH)CH_2O$-$(EO)_{20-120}$—$C_{2-26}$, for example the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

As a further nonionic surfactant, a surfactant of the general formula $R^1CH(OH)CH_2O$—$(CH_2CH_2O)_{20-120}$—$R^2$, where $R^1$ and $R^2$ independently stand for a linear or branched aliphatic hydrocarbon radical containing 2 to 20 carbon atoms, is particularly preferred.

Also preferred are surfactants of the formula $R^1O[CH_2CH(CH_3)O]_x[CH_2CH_2O]_yCH_2CH(OH)R^2$, in which $R^1$ stands for a linear or branched aliphatic hydrocarbon radical containing 4 to 22 carbon atoms or mixtures thereof, $R^2$ stands for a linear or branched hydrocarbon radical containing 2 to 26 carbon atoms or mixtures thereof, and x stands for values between 0.5 and 4, preferably between 0.5 and 1.5, and y stands for a value of at least 15.

Surfactants of the general formula $R^1O[CH_2CH(CH_3)O]_x[CH_2CH_2O]_yCH_2CH(OH)R^2$ are also preferred, in which $R^1$ stands for a linear or branched aliphatic hydrocarbon radical containing 4 to 22 carbon atoms or mixtures thereof, $R^2$ stands for a linear or branched hydrocarbon radical containing 2 to 26 carbon atoms or mixtures thereof, and x stands for a value between 1 and 40 and y stands for a value between 15 and 40, wherein the alkylene units $[CH_2CH(CH_3)O]$ and $[CH_2CH_2O]$ are randomized, i.e., present in the form of a statistical random distribution.

The group of preferred end group-closed poly(oxyalkylated) nonionic surfactants also includes nonionic surfactants of the formula $R^1O[CH_2CH_2O]_x[CH_2CH(R^3)O]_yCH_2CH(OH)R^2$, in which $R^1$ and $R^2$ independently stand for a linear or branched, saturated or mono- or polyunsaturated hydrocarbon radical containing 2 to 26 carbon atoms, $R^3$ is independently selected from —$CH_3$, —$CH_2CH_3$, —$CH_2CH_2$—$CH_3$, —$CH(CH_3)_2$, but preferably stands for —$CH_3$, and x and y independently stand for values between 1 and 32, wherein nonionic surfactants with $R^3$=—$CH_3$ and values for x of 15 to 32 and for y of 0.5 and 1.5 are very particularly preferred.

Further nonionic surfactants which are preferably usable are the end group-closed poly(oxyalkylated) nonionic surfactants of the formula $$R^1O[CH_2CH(R^3)O]_x[CH_2]_kCH(OH)[CH_2]_jOR^2,$$

in which $R^1$ and $R^2$ stand for linear or branched, saturated or unsaturated, aliphatic or aromatic hydrocarbon radicals containing 1 to 30 carbon atoms, $R^3$ stands for H or a methyl, ethyl, n-propyl, isopropyl, n-butyl, 2-butyl, or 2-methyl-2-butyl radical, x stands for values between 1 and 30, and k and j stand for values between 1 and 12, preferably between 1 and 5. When the value of x≥2, each $R^3$ in the above formula $R^1O[CH_2CH(R^3)O]_x[CH_2]_kCH(OH)[CH_2]_jOR^2$ may be different. $R^1$ and $R^2$ are preferably linear or branched, saturated or unsaturated, aliphatic or aromatic hydrocarbon radicals containing 6 to 22 carbon atoms, radicals containing 8 to 18 C atoms being particularly preferred. H, —$CH_3$, or —$CH_2CH_3$ are particularly preferred for the radical $R^3$. Particularly preferred values for x are in the range of 1 to 20, in particular 6 to 15.

As described above, each $R^3$ in the above formula may be different if x≥2. Thus, the alkylene oxide unit in brackets may be varied. If x stands for 3, for example, the radical $R^3$ may be selected for forming ethylene oxide ($R^3$=H) or propylene oxide ($R^3$=$CH_3$) units which may be joined in any given sequence, for example (EO)(PO)(EO), (EO)(EO)(PO), (EO)(EO)(EO), (PO)(EO)(PO), (PO)(PO)(EO), and (PO)(PO)(PO). The value 3 for x has been selected as an example, and may in fact be larger, wherein the range of variation increases with increasing values of x, and, for example, includes a large number of (EO) groups combined with a small number (PO) groups, or vice versa.

Particularly preferred end group-closed poly(oxyalkylated) alcohols of the above formula have values of k=1 and j=1, so that the above formula simplifies to $$R^1O[CH_2CH(R^3)O]_xCH_2CH(OH)CH_2OR^2.$$

In the latter formula, $R^1$, $R^2$, and $R^3$ are defined as above, and x stands for the numbers 1 to 30, preferably 1 to 20, in particular 6 to 18. Surfactants are particularly preferred in which the radicals 10 and $R^2$ contain 9 to 14 C atoms, $R^3$ stands for H, and x assumes values of 6 to 15.

Further preferred nonionic surfactants that are used are nonionic surfactants of the general formula $R^1O(AlkO)_xM(OAlk)_yOR^2$, where $R^1$ and $R^2$ independently stand for a branched or unbranched, saturated or unsaturated, optionally hydroxylated alkyl radical containing 4 to 22 carbon atoms;

Alk stands for a branched or unbranched alkyl radical containing 2 to 4 carbon atoms;

x and y independently stand for values between 1 and 70; and

M stands for an alkyl radical from the group $CH_2$, $CHR^3$, $CR^3R^4$, $CH_2CHR^3$, and $CHR^3CHR^4$, where $R^3$ and $R^4$ independently stand for a branched or unbranched, saturated or unsaturated alkyl radical containing 1 to 18 carbon atoms.

In this regard, nonionic surfactants of the general formula $R^1$—$CH(OH)CH_2$—$O(CH_2CH_2O)_xCH_2CHR(OCH_2CH_2)_yO$—$CH_2CH(OH)$—$R^2$ are preferred, where R, $R^1$, and $R^2$ independently stand for an alkyl radical or alkylene radical containing 6 to 22 carbon atoms; and x and y independently stand for values between 1 and 40.

In this regard, in particular compounds of the general formula $R^1$—$CH(OH)CH_2$—$O(CH_2CH_2O)_xCH_2CHR(OCH_2CH_2)_yO$—$CH_2CH(OH)$—$R^2$ are preferred in which R stands for a linear saturated alkyl radical containing 8 to 16 carbon atoms, preferably 10 to 14 carbon atoms, and n and m independently have values of 20 to 30. Corresponding compounds may be obtained, for example, by reacting alkyl diols HO—CHR—$CH_2$—OH with ethylene oxide, followed by a reaction with an alkyl epoxide to close the free OH functions, forming a dihydroxy ether.

In another preferred embodiment, the nonionic surfactant is selected from nonionic surfactants of the general formula $R^1$—$O(CH_2CH_2O)_xCR^3R^4(OCH_2CH_2)_yO$—$R^2$, in which $R^1$ and $R^2$ independently stand for an alkyl radical or alkylene radical containing 4 to 22 carbon atoms;

$R^3$ and $R^4$ independently stand for H or for an alkyl radical or alkylene radical containing 1 to 18 carbon atoms; and x and y independently stand for values between 1 and 40.

In this regard, in particular compounds of the general formula $R^1—O(CH_2CH_2O)_xCR^3R^4(OCH_2CH_2)_yO—R^2$ are preferred in which $R^3$ and $R^4$ stand for H, and the indices x and y independently assume values of 1 to 40, preferably 1 to 15.

In particular, compounds of the general formula $R^1—O(CH_2CH_2O)_xCR^3R^4(OCH_2CH_2)_yO—R^2$ are particularly preferred in which the radicals $R^1$ and $R^2$ independently represent saturated alkyl radicals containing 4 to 14 carbon atoms, and the indices x and y independently assume values of 1 to 15, in particular 1 to 12.

Also preferred are those compounds of the general formula $R^1—O(CH_2CH_2O)_xCR^3R^4(OCH_2CH_2)_yO—R^2$ in which one of the radicals $R^1$ and $R^2$ is branched.

Very particularly preferred are compounds of the general formula $R^1—O(CH_2CH_2O)_xCR^3R^4(OCH_2CH_2)_yO—R^2$ in which the indices x and y independently assume values of 8 to 12.

The stated C chain lengths and the degrees of ethoxylation or degrees of alkoxylation of the above-mentioned nonionic surfactants represent statistical mean values, which for a particular product may correspond to a whole number or a fractional number. Due to the manufacturing processes, commercial products having the mentioned formulas are usually composed not of an individual representative, but, rather, from mixtures, so that mean values, and consequently fractional numbers, may result for the C chain lengths and for the degrees of ethoxylation or degrees of alkoxylation.

Of course, the above-mentioned nonionic surfactants may be used not only as individual substances, but also as surfactant mixtures of two, three, four, or more surfactants. The term "surfactant mixtures" refers not to mixtures of nonionic surfactants which as a whole fall under one of the above-mentioned general formulas, but, rather, to those mixtures containing two, three, four, or more nonionic surfactants which may be described by different formulas of the above-mentioned general formulas.

By the use of the above-described nonionic surfactants having one free hydroxyl group on one of the two terminal alkyl radicals, the clear rinse performance and drying may be greatly improved compared to conventional polyalkoxylated fatty alcohols without a free hydroxyl group.

In one preferred embodiment, the content of the nonionic surfactants, based on the overall composition, is 0.1 to 20% by weight, particularly preferably 0.5 to 15% by weight, in particular 2 to 10% by weight.

Preferred embodiments of the present invention contain at least one anionic polymer as a further component. Preferred anionic polymers are the copolymeric polycarboxylates and the copolymeric polysulfonates (sulfopolymers). Mixtures of these polymers may also be used. In one preferred embodiment, the weight fraction of the anionic polymer, based on the overall compositions, is 0.1 to 20% by weight, preferably 0.5 to 18% by weight, particularly preferably 1.0 to 15% by weight, in particular 4 to 14% by weight.

A particularly preferred subject matter of the present invention relates to one or more copolymeric anionic polymers selected from the group of hydrophobically modified polycarboxylates and the sulfopolymers. An improvement in the clear rinse and drying properties of these agents, and at the same time low deposit formation, may be achieved using such a mixture of anionic copolymers.

The copolymers may include two, three, four, or more different monomer units.

Preferred copolymeric sulfopolymers contain, in addition to sulfonic acid group-containing monomer(s), at least one monomer from the group of unsaturated carboxylic acids.

Particularly preferably used as unsaturated carboxylic acid(s) are unsaturated carboxylic acids of the formula $R^1(R^2)C{=}C(R^3)COOH$, in which $R^1$ to $R^3$ independently stand for —H, $—CH_3$, a straight-chain or branched saturated alkyl radical containing 2 to 12 carbon atoms, a straight-chain or branched, mono- or polyunsaturated alkenyl radical containing 2 to 12 carbon atoms, alkyl or alkenyl radicals as defined above which are substituted with —H, $—CH_3$, —OH, or —COOH, or stand for —COOH or $—COOR^4$, where $R^4$ is a saturated or unsaturated, straight-chain or branched hydrocarbon radical containing 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenylacrylic acid, maleic acid, maleic acid anhydride, fumaric acid, itaconic acid, citraconic acid, methylenemalonic acid, sorbic acid, cinnamic acid, or mixtures thereof.

Sulfonic acid group-containing monomers of the formula $$R^5(R^6)C{=}C(R^7)—X—SO_3H$$

are preferred in which $R^5$ to $R^7$ independently stand for —H, $—CH_3$, a straight-chain or branched saturated alkyl radical containing 2 to 12 carbon atoms, a straight-chain or branched, mono- or polyunsaturated alkenyl radical containing 2 to 12 carbon atoms, alkyl or alkenyl radicals as defined above which are substituted with $—NH_2$, —OH, or —COOH, or stand for —COOH or $—COOR^4$, where $R^4$ is a saturated or unsaturated, straight-chain or branched hydrocarbon radical containing 1 to 12 carbon atoms, and X stands for an optionally present spacer group selected from $—(CH_2)_n—$, where n=0 to 4, $—COO—(CH_2)_k—$, where k=1 to 6, $—C(O)—NH—C(CH_3)_2—$, $—C(O)—NH—C(CH_3)_2—CH_2—$, and $—C(O)—NH—CH(CH_3)—CH_2—$.

Of these monomers, those of formulas $$H_2C{=}CH—X—SO_3H$$

$$H_2C{=}C(CH_3)—X—SO_3H$$

$$HO_3S—X—(R^6)C{=}C(R^7)—X—SO_3H$$

are preferred, in which $R^6$ and $R^7$ are independently selected from —H, $—CH_3$, $—CH_2CH_3$, $—CH_2CH_2CH_3$, and $—CH(CH_3)_2$, and X stands for an optionally present spacer group selected from $—(CH_2)_n—$ where n=0 to 4, $—COO—(CH_2)_k—$, where k=1 to 6, $—C(O)—NH—C(CH_3)_2—$, $—C(O)—NH—C(CH_3)_2—CH_2—$, and $—C(O)—NH—CH(CH_3)—CH_2—$.

Particularly preferred sulfonic acid group-containing monomers are 1-acrylamido-1-propane sulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzenesulfonic acid, methallyloxybenzenesulfonic acid, 2-hydroxy-3-(2-propenyloxyl)propanesulfonic acid, 2-methyl-2-propene-1-sulfonic acid, styrenesulfonic acid, vinylsulfonic acid, 3-sulfopropylacrylate, 3-sulfopropylmethacrylate, sulfomethacrylamide, sulfomethylmethacrylamide, and mixtures of the mentioned acids or their water-soluble salts.

The sulfonic acid groups may be present in the polymers partially or completely in neutralized form; i.e., the acidic hydrogen atom of the sulfonic acid group may be substituted with metal ions, preferably alkali metal ions, in particular sodium ions, in some or all sulfonic acid groups. The use of partially or completely neutralized sulfonic acid group-containing copolymers is preferred according to the invention.

For copolymers which contain only carboxylic acid group-containing monomers and sulfonic acid group-containing monomers, the monomer distribution of the copolymers preferably used according to the invention is in each case preferably 5 to 95% by weight; the proportion of the sulfonic acid group-containing monomer is particularly preferably 50 to 90% by weight, and the proportion of the carboxylic acid group-containing monomer is particularly preferably 10 to 50% by weight, the monomers preferably being selected from those mentioned above.

The molar mass of the sulfo copolymers preferably used according to the invention may be varied in order to adapt the properties of the polymers to the intended purpose. Preferred machine dishwasher detergents are characterized in that the copolymers have molar masses of 2000 to 200,000 $gmol^{-1}$, preferably 4000 to 25,000 $gmol^{-1}$, in particular 5000 to 15,000 $gmol^{-1}$.

In another preferred embodiment, the copolymers include, in addition to carboxyl group-containing monomer and sulfonic acid group-containing monomer, at least one nonionic, preferably hydrophobic, monomer. It has been possible to improve in particular the clear rinse performance of machine dishwasher detergents according to the invention by using these hydrophobically modified polymers.

In another preferred embodiment of the invention, the agents contain at least one anionic copolymer containing i) carboxylic acid group-containing monomer(s)

ii) sulfonic acid group-containing monomer(s)

iii) nonionic monomer(s).

As nonionic monomers, monomers of the general formula $R^1(R^2)C{=}C(R^3){-}X{-}R^4$ are preferably used in which $R^1$ to $R^3$ independently stand for —H, —$CH_3$, or —$C_2H_5$, X stands for an optionally present spacer group selected from —$CH_2$—, —C(O)O—, and —C(O)—NH—, and $R^4$ stands for a straight-chain or branched, saturated alkyl radical containing 2 to 22 carbon atoms or for an unsaturated, preferably aromatic, radical containing 6 to 22 carbon atoms.

Particularly preferred nonionic monomers are butene, isobutene, pentene, 3-methylbutene, 2-methylbutene, cyclopentene, hexene, 1-hexene, 2-methyl-1-pentene, 3-methyl-1-pentene, cyclohexene, methylcyclopentene, cycloheptene, methylcyclohexene, 2,4,4-trimethyl-1-pentene, 2,4,4-trimethyl-2-pentene, 2,3-dimethyl-1-hexene, 2,4-diemthyl-1-hexene, 2,5-dimethyl-1-hexene, 3,5-dimethyl-1-hexene, 4,4-dimethyl-1-hexane, ethylcyclohexyne, 1-octene, α-olefins containing 10 or more carbon atoms, such as 1-decene, 1-dodecene, 1-hexadecene, 1-octadecene, and $C_{22}$ α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid 2-ethylhexyl ester, methacrylic acid 2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl)acrylamide, acrylic acid stearyl ester, methacrylic acid stearyl ester, N-(stearyl)acrylamide, acrylic acid behenyl ester, methacrylic acid behenyl ester, and N-(behenyl)acrylamide, or mixtures thereof.

Cationic or amphoteric polymers may also be suitable. These include, for example, copolymers of diallylammonium salts and acrylamides, quatemized vinyl pyrrolidone/vinyl imidazole polymers such as Luviquat® (BASF), condensation products of polyglycols and amines, polyethyleneimine, copolymers of acrylic acid with dimethyldiallylammonium chloride (Merquat® 550/Chemviron), polyaminopolyamides and their crosslinked water-soluble polymers, and quatemized ammonium salt polymers. Amphoteric polymers as described in Unexamined Patent Applications WO 2010/107554 and WO 2010/000629 are particularly preferred. These involve polymers containing a) at least one monomer according to the formula

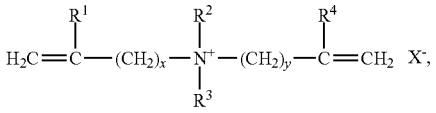

where $R_1$ and $R_4$ independently stand for hydrogen or $C_{1-6}$ alkyl;

$R_2$ and $R_3$ independently stand for $C_{1-6}$ alkyl, hydroxy-$C_{1-6}$alkyl, or amino-$C_{1-6}$ alkyl;

m and n independently stand for a value of 1 to 3;

X stands for a counterion;

b) at least one hydrophilic monomer which bears at least one acid group;

c) at least one hydrophilic nonionic monomer.

Examples of suitable alkali carriers are the hydroxides, preferably alkali metal hydroxides, the carbonates, hydrogen carbonates, or sesquicarbonates, preferably alkali metal carbonates, alkali metal hydrogen carbonates, and alkali metal sesquicarbonates; within the meaning of the present invention, preferably the alkali metal hydroxides and alkali carbonates, in particular sodium hydroxide, potassium hydroxide, sodium carbonate, sodium hydrogen carbonate, or sodium sesquicarbonate, may be used.

It has been shown that the performance of the cleaning agents may be enhanced by organic solvents. These organic solvents come, for example, from the groups of monoalcohols, diols, triols, and polyols, ethers, esters, and/or amides. Particularly preferred are organic solvents that are water-soluble; within the meaning of the present patent application, "water-soluble" solvents are solvents that are completely miscible, i.e., without a miscibility gap, with water.

Organic solvents that may be used in the agents according to the invention preferably come from the group of monohydric or polyhydric alcohols, alkanolamines, or glycol ethers, provided that they are miscible with water in the stated concentration range. Preferred are solvents selected from ethanol, n-propanol, or isopropanol, butanols, glycol, propanediol or butanediol, glycerin, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl, or propyl ether, dipropylene glycol methyl or ethyl ether, methoxy, ethoxy, or butoxytriglycol, 1-butoxyethoxy-2-propanol, 3-methyl-3-methoxybutanol, propylene glycol t-butyl ether, and mixtures of these solvents.

The organic solvents from the group of organic amines and/or alkanolamines have proven to be particularly effective with regard to cleaning performance, in particular with regard to cleaning performance on bleachable soils, in particular tea soils.

Preferred dyes, whose selection poses no difficulty to those skilled in the art, have high stability during storage, and insensitivity to the customary ingredients of the agents and to light, and have no pronounced substantivity to the substrates, such as textiles, glass, ceramic, or plastic dishware, to be treated with the dye-containing agents, so as not to stain same.

In addition, preservatives may be contained in the agents. Examples of suitable preservatives are those from the groups of alcohols, aldehydes, antimicrobial acids or their salts, carboxylic acid esters, acidamides, phenols, phenol derivatives, diphenyls, diphenylalkanes, urea derivatives, oxygen or nitrogen acetals and formals, benzamidines, isothiazoles and their derivatives such as isothiazolines and isothiazolinones, phthalimide derivatives, pyridine derivatives, antimicrobial surface-active compounds, guanidine, antimicrobial amphoteric compounds, quinoline, 1,2-dibromo-2,4-dicyanobutane, iodo-2-propynylbutyl carbamate, iodine, iodophors, and peroxides. Preferred antimicrobial active substances are preferably selected from the group comprising ethanol, n-propanol, isopropanol, 1,3-butanediol, phenoxyethanol, 1,2-propylene glycol, glycerin, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxydiphenyl ether, N-(4-chlorophenyl)-N-(3,4-dichlorophenyl) urea, N,N'-(1,10-decandiyldi-1-pyridinyl-4-ylidene)-bis-(1-octanamine) dihydrochloride, N,N'-bis-(4-chlorophenyl)-3,12-diimino-2,4,11,13-tetraazatetradecanediimidamide, antimicrobial quaternary surface-active compounds, and guanidine. However, particularly preferred preservatives are selected from the group comprising salicylic acid, quaternary surfactants, in particular benzalkonium chloride, and isothiazoles and their derivatives, such as isothiazolines and isothiazolinones.

Phosphonates are generally used as complexing agents; they may be used in composition A or in composition B or in both composition A and composition B. Preferred phosphonates are hydroxyethane diphosphonates and diethylenetriamine penta(methylenephosphonates). In one preferred embodiment of the invention, at least composition B contains phosphonates; preferably both composition A and composition B contain phosphonates. The content of phosphonates in the agents is preferably 1 to 10% by weight.

The pH of compositions A and B at 20° C. is within the customary range. The enzyme-containing composition A preferably has a pH (20° C.) between 6 and 9; the pH of composition B is dependent on the particular ingredients selected, but may in fact be higher than the pH of composition A.

In one preferred embodiment of the invention, composition B contains a peroxo bleaching agent, bleach activators, and/or bleach catalysts. Although in principle any of the known peroxo bleaching agents may be used, it is particularly preferred that composition B contains a percarbonate or a peroxocarboxylic acid, for example from the compound class of imidoperoxocarboxylic acids.

Suitable examples of peroxocarboxylic acid are peroxoformic acid, peroxoacetic acid, peroxopropionic acid, peroxohexanoic acid, peroxobenzoic acid, and their substituted derivatives such as m-chloroperoxobenzoic acid, mono- or diperoxophthalic acids, 1,12-diperoxododecanoic diacid, nonylamidoperoxoadipic acid, 6-hydroxyperoxohexanoic acid, 4-phthalimidoperoxobutanoic acid, 5-phthalimidoperoxopentanoic acid, 6-phthalimidoperoxohexanoic acid, 7-phthalimidoperoxoheptanoic acid, N,N'-terephthaloyl-di-6-aminoperoxohexanoic acid, and mixtures of same. The use of imidoperoxocarboxylic acids is preferred. 6-Phthalimidoperoxohexanoic acid is included in the particularly preferred imidoperoxocarboxylic acids.

The individual partial compositions may be solid, paste-like, or liquid, or may also contain mixtures of solid components with liquid or paste-like components. In one preferred embodiment of the invention, an aqueous dispersion of a peroxocarboxylic acid is present in composition B, which may contain between 1 and 40% by weight of a peroxocarboxylic acid. The aqueous dispersion advantageously contains 1 to 20% by weight imidoperoxocarboxylic acid and particularly preferably 1 to 10% by weight imidoperoxocarboxylic acid, in particular 6-phthalimidoperoxohexanoic acid.

In one preferred embodiment of the invention, composition B contains peroxo bleaching agent as well as phosphonate. The weight ratio of the peroxo bleaching agent to the phosphonate is advantageously 0.5:1 to 5:1, preferably 1:1 to 4:1, a composition B being particularly preferred which contains peroxo bleaching agent, in particular of the imidoperoxocarboxylic acid type, and phosphonate in a weight ratio greater than 1:1.

Compositions A and B may be present in any given ratio with respect to one another. In one preferred embodiment of the invention, however, the proportion of composition A in the overall composition is 40 to 98% by weight, in particular 50 to 95% by weight, while the proportion of composition B in the overall composition is 2 to 60% by weight, in particular 5 to 50% by weight.

In another embodiment of the invention, an automatic detergent or cleaning agent method, in particular a machine dishwasher detergent method, is claimed, wherein for a combination product according to the invention, comprising a packaging means and at least two free-flowing detergent or cleaning compositions A and B that are situated in the packaging means and separate from one another, the detergent or cleaning compositions A and B are dosed from the combination product into a dosing device provided in the machine or into a separate dosing device or directly into the machine, and the washing or cleaning operation is subsequently started. The two compositions A and B have the following compositions:

A: 10 to 75% by weight builder(s);

0.1 to 10% by weight enzyme preparation;

24.9 to 89.9% by weight water; and

B: less than 0.1% by weight enzyme preparation;

0.5 to 90% by weight water; and at least one further ingredient of detergent or cleaning agents, preferably at least one peroxo bleaching agent, wherein the two compositions A and B have each been set to a viscosity of greater than 1500 mPas.

Examples

In the case of the product according to the invention, 20 g each of compositions A and B were provided from a two-chamber flask into the dosing chamber of a Miele G698SC dishwasher (program: 50° C.; water having a hardness of 21° dH), and were tested against a comparative product under IKW standard conditions, wherein composition B of the comparative product had a much lower viscosity than composition B of the product according to the invention.

TABLE 1

| Composition A in % by weight | | |
|---|---|---|
| Composition A | Product | Comparison |
| Tripolyphosphate | 23 | 23 |
| Protease preparation | 3.0 | 3.0 |
| Amylase preparation | 1.00 | 1.0 |
| Fatty alcohol-$(EO)_{22}$-2-hydroxyalkyl ether | 5.0 | 5.0 |
| Acrylic acid sulfopolymer (Na salt) | 12.0 | 12.0 |
| Phosphonate | 2.4 | 2.4 |
| Sodium citrate | 5.0 | 5.0 |
| Monoethanolamine | 7.0 | 7.0 |
| Remaining components and water | To make 100 | To make 100 |
| Viscosity (Brookfield DV-II + Pro viscometer; 25 spindle, 50 rpm, 20° C.) | 4200 mPas | 4200 mPas |

TABLE 2

| Composition B in % by weight | | |
|---|---|---|
| Composition B | Product | Comparison |
| 6-Phthalimidoperoxohexanoic acid | 4 | 4 |
| Phosphonate | 0.6 | 0.6 |
| Xanthan gum | 1.5 | <0.5 |
| Water | To make 100 | To make 100 |
| Viscosity (Brookfield DV-II + Pro viscometer; 25 spindle, 50 rpm, 20° C.) | 4000 mPas | 350 mPas |

TABLE 3

| Cleaning results for various soils | | | |
|---|---|---|---|
| | Tea | Egg yolk | Starch mix |
| Product | 9.0 | 2.4 | 8.0 |
| Comparison | 8.0 | 2.1 | 7.0 |

While for soils such as milk, ground meat, and oatmeal, virtually identical cleaning performance was found for the product according to the invention and the comparative product, for egg yolk and in particular tea and starch soils, the advantages of the product according to the invention were clearly visible compared to the comparative product.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. Combination product comprising a packaging means and at least two free-flowing detergent or cleaning compositions A and B that are situated in the packaging means and separate from one another, wherein the two compositions A and B each comprise a thickening agent selected from the group consisting of acrylic acid homopolymers, acrylic acid copolymers, and polysaccharides; and wherein respectively A and B further comprise:

A: 10 to 75% by weight builder(s);
0.1 to 10% by weight enzyme preparation;
24.9 to 89.9% by weight water; and B: less than 0.1% by weight enzyme preparation;
0.5 to 90% by weight water; and
1 to 40% by weight of a peroxocarboxylic acid;

wherein the two compositions A and B each have a viscosity of greater than 1500 mPas (measured with a DV-II+Pro Brookfield viscometer, 25 spindle, 50 rpm, 20° C.); wherein composition B viscosity has a viscosity of from 3000 and 7000 mPas (measured with a DV-II+Pro Brookfield viscometer, 25 spindle, 50 rpm, 20° C.), and wherein composition A viscosity is less than that of composition B.

2. Combination product according to claim 1, wherein the packaging means represents a two- or multi-chamber container which is insoluble in water, wherein each of the receiving chambers of the packaging means is provided with an outlet.

3. Combination product according to claim 1, wherein the viscosity of both compositions A and B, is above 2000 mPas.

4. Combination product according to claim 1, wherein composition B contains a peroxo bleaching agent.

5. Combination product according to claim 1, wherein phosphonates are contained in composition A and/or B.

6. Combination product according to claim 1, wherein composition B comprises peroxo bleaching agent and phosphonate, and wherein composition A comprises phosphonate.

7. Combination product according to claim 1, wherein the weight ratio of peroxo bleaching agent to phosphonate in composition B is 0.5:1 to 5:1.

8. Combination product according to claim 1, wherein the proportion of composition A in the overall composition is 40 to 98% by weight, while the proportion of composition B in the overall composition is 2 to 60% by weight.

9. Automatic detergent or cleaning agent method, wherein the detergent or cleaning compositions A and B are dosed from a combination product according to claim 1 into a dosing device provided in the machine or into a separate dosing device or directly into the machine, and the washing or cleaning operation is subsequently started.

* * * * *